United States Patent [19]

Pattiselanno

[11] Patent Number: 4,562,679

[45] Date of Patent: Jan. 7, 1986

[54] HOLDER OF CONNECTING BARS FOR PROVIDING A POSITIVE CONNECTION OF TWO STRUCTURAL MEMBERS

[75] Inventor: Job Pattiselanno, Hinterkappelen, Switzerland

[73] Assignee: Losinger AG, Bern, Switzerland

[21] Appl. No.: 413,345

[22] PCT Filed: Nov. 3, 1981

[86] PCT No.: PCT/CH81/00119

§ 371 Date: Aug. 19, 1982

§ 102(e) Date: Aug. 19, 1982

[87] PCT Pub. No.: WO82/02223

PCT Pub. Date: Jul. 8, 1982

[30] Foreign Application Priority Data

Dec. 29, 1980 [EP] European Pat. Off. ..... 80810414.5

[51] Int. Cl.[4] ..... E04B 1/38

[52] U.S. Cl. ..... 52/378; 52/699; 52/698

[58] Field of Search ..... 52/378, 731, 242, 221, 52/220, 239, 699, 698

[56] References Cited

U.S. PATENT DOCUMENTS

| | | | |
|---|---|---|---|
| 2,573,345 | 10/1951 | Leedy | 52/731 |
| 2,754,064 | 7/1956 | Voltz et al. | 52/731 |
| 3,609,211 | 9/1971 | Van Herk | 52/221 |
| 3,708,607 | 1/1973 | Brode et al. | 52/221 |
| 3,868,804 | 3/1975 | Tantlinger | 52/731 |
| 3,894,370 | 7/1975 | Parazader | 52/220 |
| 4,338,757 | 7/1982 | Witschi et al. | 52/378 |

FOREIGN PATENT DOCUMENTS

| | | | |
|---|---|---|---|
| 1926251 | 11/1970 | Fed. Rep. of Germany | 52/731 |
| 1684196 | 4/1971 | Fed. Rep. of Germany | 52/699 |
| 2129779 | 12/1972 | Fed. Rep. of Germany | 52/731 |
| 2365732 | 3/1976 | Fed. Rep. of Germany | 52/731 |
| 1286861 | of 1962 | France | 52/378 |
| 562376 | 5/1975 | Switzerland | 52/699 |
| 2039581 | 8/1980 | United Kingdom | 52/699 |

*Primary Examiner*—Donald G. Kelly
*Assistant Examiner*—Michael Safavi
*Attorney, Agent, or Firm*—Oldham, Oldham & Weber Co.

[57] ABSTRACT

The holder exhibits a basic part (16), consisting of a bottom part (5) and two longitudinal side parts (6), and a flexible cover part (7). The individual parts (5, 6, 7) of the holder are detachably interconnected by means of snap fasteners (8). The cover part (7) is provided with opposing slots (11) extending from its longitudinal edges. Second sections (**14*b*) of the connecting bars (14) are introduced into the slots (11), the slots (11) closely surrounding the second sections (14*b*) of the connecting bars (14). The individual parts (5, 6, 7) are easy to assemble and disassemble. At least the longitudinal side parts (6) are reusable. By means of snap fasteners (8), a simple detachable connection of the parts (5, 6, 7**) is provided.

1 Claim, 3 Drawing Figures

Figure 1:
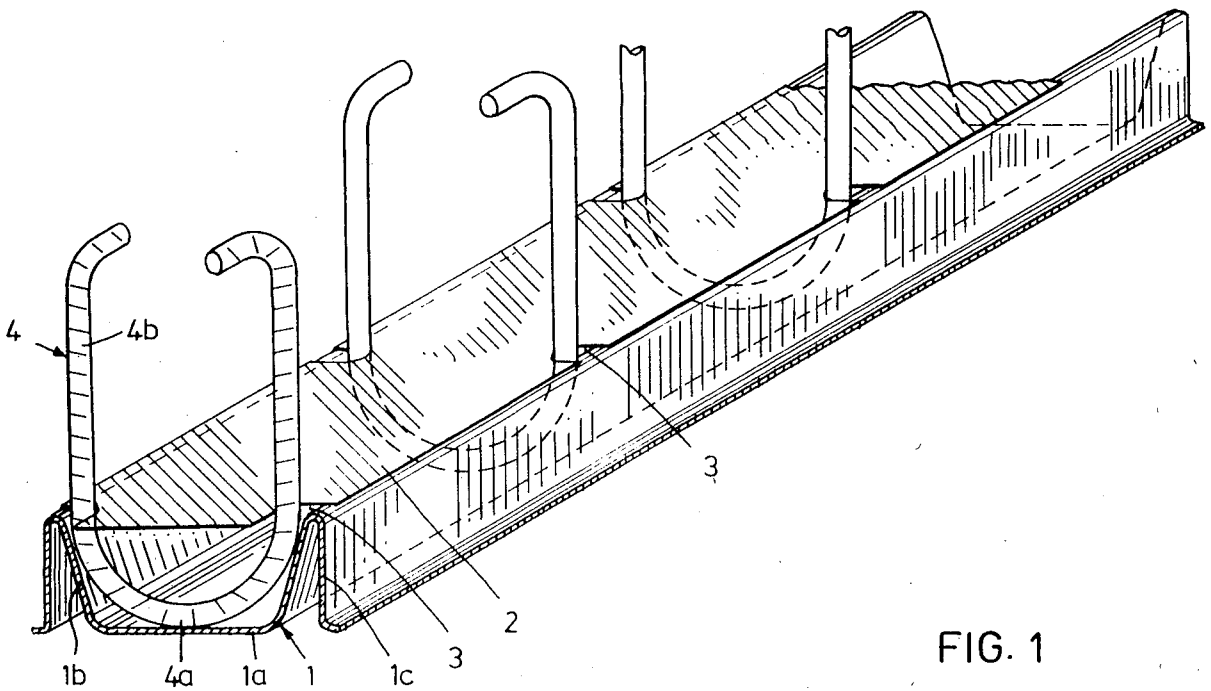

HOLDER OF CONNECTING BARS FOR PROVIDING A POSITIVE CONNECTION OF TWO STRUCTURAL MEMBERS

The invention starts from a holder of connecting bars for providing a positive connection of one structural member to another structural member to be concreted previously, with a basic part in which first sections of the connecting bars, to be connected to the one structural member, are accomodated, and a part covering these first sections and detachably connected to the basic part.

This connection may be a matter of joining structural members of different kinds, as is the case, e.g., in attachments of lines under a ceiling of a building or in the mounting of a facing on a concrete wall, or it may also have to do with a positive connection of two structural members concreted with a time lag, such as wall-to-wall, wall-to-stairs, or similar connections, for example. Such connections may be produced subsequently, e.g., by boring and doweling in the solid concrete wall, but they are often advantageously prepared in the first concreted structural member by incorporating the connecting elements even before the pouring of this part. In order to avoid apertures in the shuttering at such time, use is made of different kinds of holding elements, the majority of which aim at the formation of a cavity in the structural member to be concreted first, in which cavity the parts of the connecting elements, usually formed as connecting bars, are accommodated, which provide for the later connection of the structural member to be fastened on.

Such a holder in the form of a pan is already known from U.S. Pat. No. 1,798,134. Broken out in the bottom of the pan are openings through which the connecting loops are inserted in such a way that a portion of the loop which is to be bound into the structural member to be concreted first projects from the bottom of the pan, and the remaining portion of the loop, which is used for the later fastening-on of the structural member to be attached, is accommodated in the pan. This pan is secured to the shuttering with the bottom of the pan facing the concrete part, i.e., with the partially open side oriented towards this shuttering, and mounted. This subsequent removal of the pan from the hardened concrete is not reckoned with. Later developed devices, as known, for example, from French Patent Specification No. 71.21518 or German Disclosed Application No. 29 44 739, work on the same principle of the pierced bottom and the connecting bars stuck through, but serve merely as preserving elements which are removed after stripping. The preserving element according to DE-OS No. 29 44 739 has the shape of a closed hollow body of prismatic form.

The above-mentioned principle, in which the bottom of the holding device is mounted facing the concrete and in which the connecting bars must be stuck through via apertures in this bottom, renders the production of such connections very difficult. Not the boring, punching, or another kind of production of such apertures per se, but the insertion of the bars, usually bent at right angles, through these narrow openings, requires a great deal of work.

The following disadvantages are inherent in the holder according to DE-OS No. 29 44 739:

the length as well as the width of the hollow body cannot be changed, i.e., the hollow body, once manufactured, is invariable in its width and length and can be used only in the given dimensions upon re-use, the manufacture of the hollow body is made more expensive by the presence of transverse sides, and the work is likewise made more costly by the subsequent boring of holes for connecting bars in the breast part of the hollow body.

The task underlying the invention indicated in patent claim 1 is to eliminate the disadvantages of the known holders and to provide a form of the holder mentioned at the beginning such that the work and thus the manufacturing costs during the insertion of the connecting bars in the holders are minimized. Furthermore, at least a part of such a holder should be re-usable. The same parts should always be usable for different embodiments of the holder.

In a holder according to the generic clause of patent claim 1, these problems ae solved in such a way that the basic part has the shape of a trough open at both ends, and the cover part is provided with lateral slots through which pass second sections of the connecting bars, intended to be bound into the other structural member.

The basic part may be in one piece and the cover part be made of expanded metal, the cover part being secured to the basic part by means of spot-welds or rivets. In another embodiment, the basic part may consist of a bottom part and two longitudinal side parts, and the cover part be made of a flexible material, which parts are connected to one another by means of snap fasteners provided for on the parts.

The subject of the invention is explained in more detail below, by way of example, with the aid of the drawings.

Figure 3:
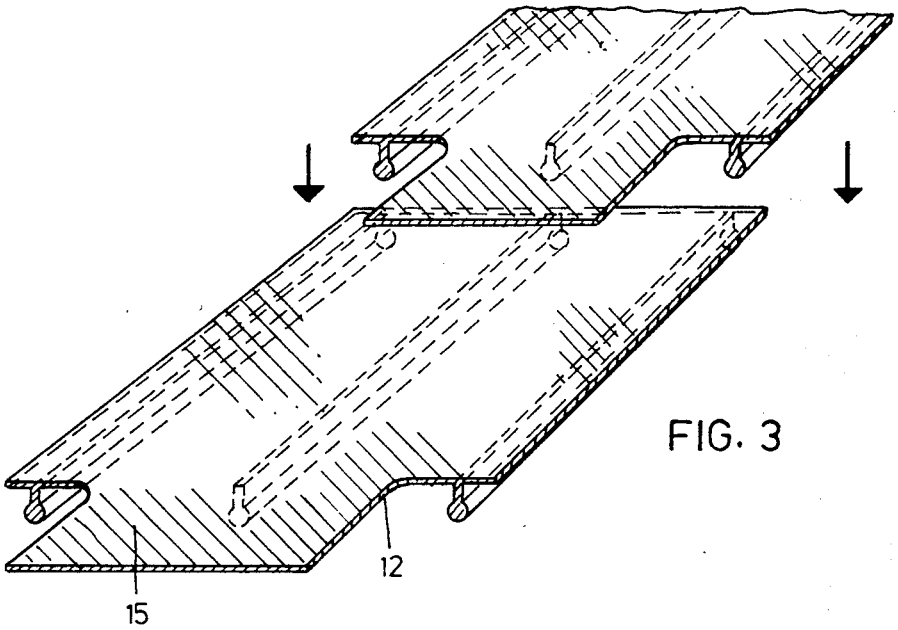
Figure 2:
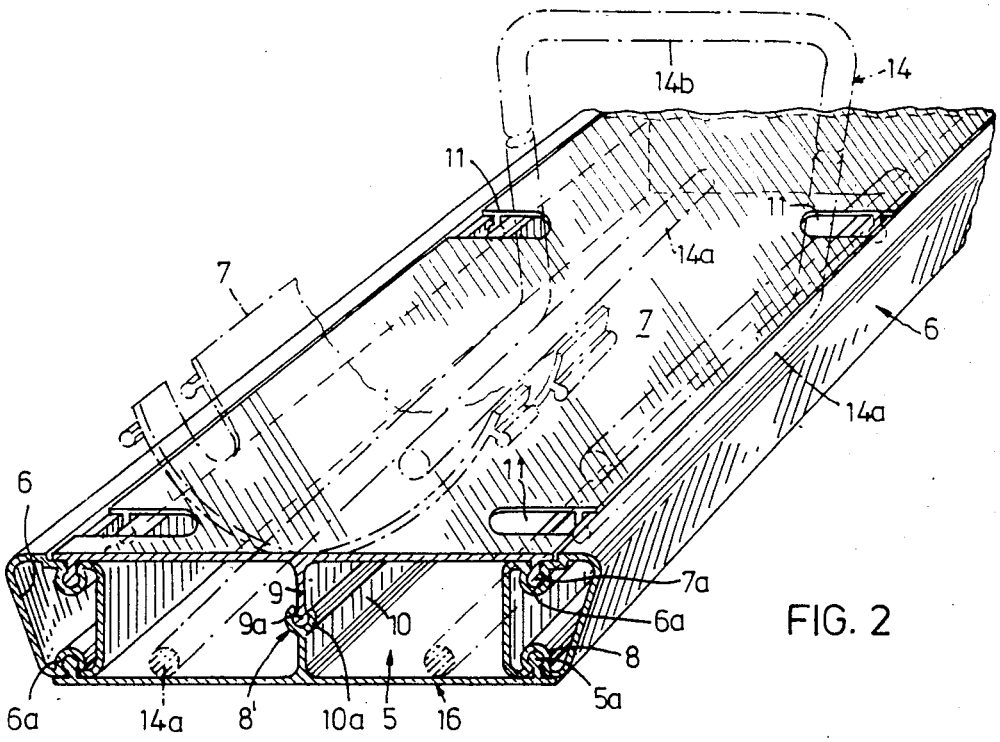

FIG. 1 shows a perspective view of a holder in which are inserted connecting bars for providing a decided connection of one structural member to another structural member to be concreted previously, FIG. 2 shows, likewise in perspective representation, another form of the holder according to the invention with connecting bars, and FIG. 3 shows a perspective view of the cover part, divided into several parts, of the holder according to FIGS. 1 and 2.

The holder according to FIG. 1 is composed of a basic part 1 and a cover part 2 which are connected to one another detachably, e.g., by means of spot-welds or rivets. The basic part 1 exhibits a bottom plate 1*a*, two longitudinal sidewalls 1*b*, and two supporting walls 1*c* and has the shape of a thin-walled trough open at both ends. Formed in the cover part 2 are opposed slots 3 leading from the edge to the middle of the cover part. If a continuous cover part is replaced by several overlapping cover parts 15, then these slots are advantageously formed as corner recesses 12 (FIG. 3). Advantageously, the holder is made of plastics, but it can be made, e.g., of sheet metal, wood, or another material. Inserted in the holder are connecting bars 4, here in the form of open U-shaped stirrups. The shape of the connecting bars is governed by the requirements of the field of application. The distance between the connecting bars 4 with respect to one another must be equal to the distance between the slots 3 in the cover part 2 through which the connecting bars are passed. During the assembly and the mounting of the holder the procedure is as follows:

The connecting bars 4 are inserted in the open basic part 1 in the right position and fixed in this position relative to one another in a manner not shown here.

Thereupon one or more cover parts 2 are inserted in such a way that the slots 3 closely surround the projecting sections 4*b* of the connecting bars 4. Finally, the cover part 2 is connected to the basic part 1, e.g., by means of spot-welds or rivets. A thus assembled holder with connecting bars is secured to the shuttering, with the bottom 1*a* of the basic part 1 facing the shuttering. The transverse sides of the holder are closed off, e.g., with an adhesive tape, a cap, or another auxiliary means, in order to prevent the penetration of the concrete to be poured.

After the structural member in which the holder with the connecting bars lies has been concreted, and the concrete already has sufficient firmness, the shuttering is taken off, thereafter the basic part 1 pulled off, and finally the cover part 2 also removed from the concrete. Accordingly, the still free sections 4*a* of the connecting bars 4, projecting from the concrete, are adjusted in accordance with the field of application. In cases where the cover part 2 does not disturb the connection to be formed between the structural members, it may be left in the concrete. In such case, it may be made of expanded metal, for example. Where the connection would be disturbed, the cover part 2 may be made of plasticizable material, for example, and be removed from the concrete.

Upon fitting of the holder according to FIG. 1 with connecting bars into the shuttering of the structural member to be concreted first, the bottom of the holder is not turned towards the concrete, as in the case of the already known devices, but towards the shuttering, and secured thereto. After setting of the concrete of this structural member and removal of the shuttering, the basic part 1 of the holder can easily be removed from the concrete body with one pull; the cover part 2, which has been of a material that does not adhere to the concrete, can also be stripped off the concrete. Another possible solution consists in making the cover part of a material which does not disturb the connection, such as expanded metal, for example, which remains in the first concrete member.

The holder according to FIG. 2 exhibits a bottom part 5, two longitudinal side parts 6, and a flexible cover part 7. The individual parts 5, 6, and 7 are detachably interconnected by means of snap fasteners 8. As is apparent from FIG. 2, such snap fasteners are provided for on both sides of the bottom part 5 as well as of the cover part 7 and in the upper and lower region of each longitudinal side part 6.

The bottom part 5 is formed as an elongated base plate of plasticizable synthetic material. On both of its longitudinal edges it exhibits cylindrical projections 5*a* which form part of the snap fastener 8. Upon the latter are set the longitudinal side parts 6 with their channel-like parts 6*a* of the snap fastener 8. The length of the bottom plate and of the side parts can be cut to size as required; for different widths of the holder, only the bottom part is to be varied, but not the side parts.

Each of the longitudinal side parts 6 represented in FIG. 2 has the shape of a profiled hollow body. If, as depicted in the figure, its outer wall forms an acute angle with the cover part 7, then after the removal of the holder from the one concrete structural member, there is formed in the same a dovetailed groove which is very advantageous for the connection of two successively concreted structural members. Like the bottom part 5, the longitudinal side parts 6 are also made of plasticizable synthetic material. Channel-like parts 6*a* of the snap fasteners 8 are provided for in the upper and lower region of each side part 6. In the upper region, cylindrical projections 7*a* of the cover part 7 snap into the same.

Like the bottom part 5 and the longitudinal side parts 6, the cover part 7 is also made of plasticizable synthetic material. The cover part 7 either has the form of an elongated plate which is flexible, or it is made, as depicted in FIG. 3, of several partially overlapping scales 15 of plastics, which are likewise flexible. The length of the cover part 7 is cut to size as required, the width may vary. In the centre of the cover part 7, in the example depicted, a rib 9 is provided for over its entire length, which rib exhibits at its free end a cylindrical projection 9*a* which again forms part of a snap fastener 8'. The other, channel-shaped part 10*a* of the snap fastener 8' is provided for at the end of a rib 10 running in the centre of the bottom part 5 over its entire length, which rib is exactly aligned towards the rib 9 of the cover part 7 and detachably connected to the same by means of the snap fastener 8'. In the case of wider bottom parts 5 and cover parts 7, the two ribs 9 and 10 aligned towards one another serve as bracing against pressure of the poured-in concrete.

On both sides of the cover part 7, opposing slots 11 are provided for, which run from the longitudinal edges of the cover part 7 in the direction of the centre line of the cover part 7. These slots 11 serve for receiving connecting bars 14, as is explained in detail further on. When the cover part is formed by several scales 15, as FIG. 3 shows, two opposing slots in the form of corner recesses 12 are provided for in each scale. The slot spacings on each side of the cover part 7 or the lengths of the scales 15 are freely selectable.

The connecting bars 14 are put into the holder either in the factory or at the construction site. The procedure at such time is as follows:

The sections 14*a* of each connecting bar 14, bent at right angles in this example and exhibiting free ends, are laid in the trough, open at both ends, formed by the side parts 6 set on the bottom part 5. The other section 14*b* of each connecting bar 14, which now runs about perpendicular to the bottom part 5 and forms, for example, a U-shaped stirrup, projects from the trough. The individual connecting bars 14 are ranged one behind the other on the bottom part 5 in such a way that the free ends, designated as sections 14*a*, of each connecting bar 14 are disposed at an acute angle to one another, so that the following free sections 14*a* of the connecting bars 14 can immediately adjoin the previous free sections 14*a* from inside. Then the flexible cover part 7 or the individual scales 15 are introduced into the space formed by sections 14*b* of the connecting bars 14 above the entire length of the trough formed by the bottom part 5 and side parts 6 in such a way that the longitudinal edges of the cover part 7 are bent upward from the rib 9. The sections 14*b* of the connecting bars 14 are then introduced into the lateral slots 11 of the cover part 7 in such a way that the cover part 7, by clapping-in of the slots 11 about the sections 14*b*, is brought into a plane running parallel to the bottom part 5.

The holder depicted in FIG. 2 with connecting bars is inserted in the shuttering in such a way that the rear side of the bottom part 5 comes to lie against the inside of the shuttering. The transverse sides of the holder are closed off, e.g., with an adhesive tape, a cap, or another auxiliary means, in order to prevent the penetration of the concrete to be poured. The sections 14*b* of the connecting bars 14 are embedded in concrete during the concreting of the one, non-depicted structural member. Since the slots 11 closely surround the sections 14*b* of the connecting bars 10 and otherwise rest against the longitudinal edges of the side parts 6, the concrete does not penetrate behind the cover part 7.

After the concrete has set and the shuttering has been taken off, first the bottom part 5 will be torn away from the side parts 6, and then the side parts 6 from the cover part 7. For the example depicted in FIG. 2, the free sections 14*a* of the stirrup-shaped connecting bars 14 are bent out into the stirrup plane of the concrete-embedded sections 14*b* of the connecting bars 14. Thereafter, the cover part 7 can also be easily removed from the concrete because it is made of a synthetic material as antagonistic to adhesion as possible. Thus the individual parts 5, 6, 7 of the device, but at least the side parts 6, are reusable.

The above-described holder can be supplied to the construction site in finished form, i.e., assembled with connecting bars 14, or also as a semi-finished product in its component parts and without connecting bars 14.

The snap fastener 8' on the ribs 9, 10 is provided for in the centre of the distance of the cover part 7 from the bottom part 5. The reason for this is that only a single mould is supposed to be used for the production of both parts; in the single mould, only the insert for the formation of the respective fastener part is replaced. The thickness of the bottom part 5 and of the cover part 7, as well as of the walls of the side parts 6, s about 1 to 2 mm. The height of the side parts 6 is about 28 mm. in the application depicted by way of example of the holder for connections between two structural members concreted with a time lag.

The above-described holder according to FIG. 2 represents a moderately priced means for preserving connecting bars; the individual parts of the holder are easy to assemble and disassemble. The parts 5, 6, and 7 are usually reusable, it being possible to utilize the side parts 6 for different widths of the bottom part 5 or of the cover part 7. By means of snap fasteners, an easily detachable connection of the parts 5, 6, 7 is provided.

I claim:

1. Holder of connecting bars for setting in concrete of two structural concrete members to provide a positive connection between themselves, having a basic part in which first sections of connecting bars, to be connected to the one structural concrete member are accommodated, and a cover part having a central line and longitudinal edges, said part covering the first sections of connecting bars and being detachably connected to the basic part, characterized in that the basic part has the shape of a trough open at both ends, and the cover part 7 is made of flexible material and is provided with lateral slots 11 directed from the longitudinal edges of the cover part toward the central line of the same, through which slots 11 pass second 14*b* sections of the connecting bars 14 intended to be bound into another structural member to be concreted, and said basic part being formed by a bottom part 5, whereby the bottom part 5 and the cover part 7 each are provided with a rib 9, 10 running in the central line of the respective part, which ribs 9, 10 are aligned in a vertical plane and connected to one another by means of a snap fastener (8') provided on the ribs to form a reinforcing partition dividing the holder in two equal hollow rooms.

* * * * *